US010798485B1

(12) United States Patent
Ivey et al.

(10) Patent No.: US 10,798,485 B1
(45) Date of Patent: Oct. 6, 2020

(54) QR CODE-BASED WALL-MOUNTED AUDIO SYSTEM ZONE CONTROLLER SYSTEM

(71) Applicant: MITEK CORP., INC., Phoenix, AZ (US)

(72) Inventors: Johnathan Ivey, Chandler, AZ (US); Tom Lureman, Granger, IN (US); Kevin Sykes, Portland, OR (US); Sam Weaver, Elkhart, IN (US); Lynn Eggli, Holladay, UT (US); Jon Stembel, Goshen, IN (US); Eduardo Arriaga, Osceola, IN (US)

( * ) Notice: Subject to any disclaimer, the term of this patent is extended or adjusted under 35 U.S.C. 154(b) by 0 days.

(21) Appl. No.: 16/434,109

(22) Filed: Jun. 6, 2019

(51) Int. Cl.
*H04R 3/12* (2006.01)
*H04R 5/02* (2006.01)
*H04R 5/04* (2006.01)

(52) U.S. Cl.
CPC ..... *H04R 3/12* (2013.01); *H04R 5/02* (2013.01); *H04R 5/04* (2013.01); *H04R 2420/07* (2013.01); *H04R 2430/01* (2013.01)

(58) Field of Classification Search
CPC combination set(s) only.
See application file for complete search history.

(56) References Cited

U.S. PATENT DOCUMENTS

2014/0108634 A1* 4/2014 Kim ..... H04L 63/20 709/223
2016/0239257 A1* 8/2016 Jeong ..... H04B 11/00

* cited by examiner

*Primary Examiner* — Duc Nguyen
*Assistant Examiner* — Assad Mohammed
(74) *Attorney, Agent, or Firm* — Keith L. Jenkins, Registered Patent Attorney LLC; Keith L. Jenkins

(57) ABSTRACT

A system of wall-mounted audio system zone controllers, each having a digital display of a QR code that is unique to that particular wall-mounted controller. By scanning the QR code with a smart phone, or the like, where that smartphone is connected to the same network as the audio processing assembly that is communicatively connected to the particular wall-mounted zone controller, a user gains access to a website that provides expanded and remote audio control functionality over and above that provided by the wall-mounted zone controller itself. A wireless network router is in communication with the audio processing assembly and with the smart phones used to scan QR codes.

20 Claims, 11 Drawing Sheets

QR CODE-BASED WALL-MOUNTED AUDIO SYSTEM ZONE CONTROLLER SYSTEM

FIELD OF ART

The present invention relates to a QR code-based wall-mounted audio system controller in the field of digital signal processing. The present invention more particularly relates to a wall-mounted audio system zone controller from which control of an audio system may be transferred to a smart phone or the like by reading a QR code, unique to the wall-mounted controller, displayed on the wall-mounted audio system controller, selecting the resultant URL, and exercising expaned control of the audio system from the resulting website.

BACKGROUND OF THE INVENTION

Acoustical engineers divide spaces into audio zones for maintaining audio quality and interaction. Wall-mounted audio system controllers are placed in zones and are used to communicate with central audio processing apparatus to vary the audio parameters in a zone where the wall-mounted audio system controller is installed. In particular, audio volume may be controlled this way. Wall-mounted audio system controllers have the disadvantage of being fixed to a wall, thereby restricting access. In addition, control capability of conventional wall-mounted audio controllers is limited. What is needed is an audio wall controller that allows a user access to an expanded suite of audio system controls from any location having a network connection after initializing that capability at the wall-mounted audio system controller.

SUMMARY OF THE INVENTION

The present invention provides a system of wall-mounted audio system zone controllers, each having a digital display of a QR code that is unique to that particular wall-mounted controller. By scanning the QR code with a smart phone, or the like, where that smartphone is connected to the same network as the audio processing assembly that is communicatively connected to the particular wall-mounted zone controller, a user gains access to a website that provides expanded and remote audio control functionality over and above that provided by the wall-mounted zone controller itself. A wireless network router is in communication with the audio processing assembly and with the smart phones used to scan QR codes.

DESCRIPTION OF THE FIGURES OF THE DRAWINGS

The present invention will hereinafter be described in conjunction with the following drawing figures, wherein like numerals denote like elements.

DETAILED DESCRIPTION OF THE INVENTION

As used and defined herein, the term "QR code" means "quick response code" and refers to a two-dimensional bar code. As used and defined herein, the term "PIN code" means a personal identification code. As used and defined herein, the term "speaker", without more, means "loudspeaker". As used and defined herein, the term "USB" means "universal serial bus". The hundreds digit(s) of the reference numbers corresponds to the number of the figure in which the item is first referenced.

Figure 1:
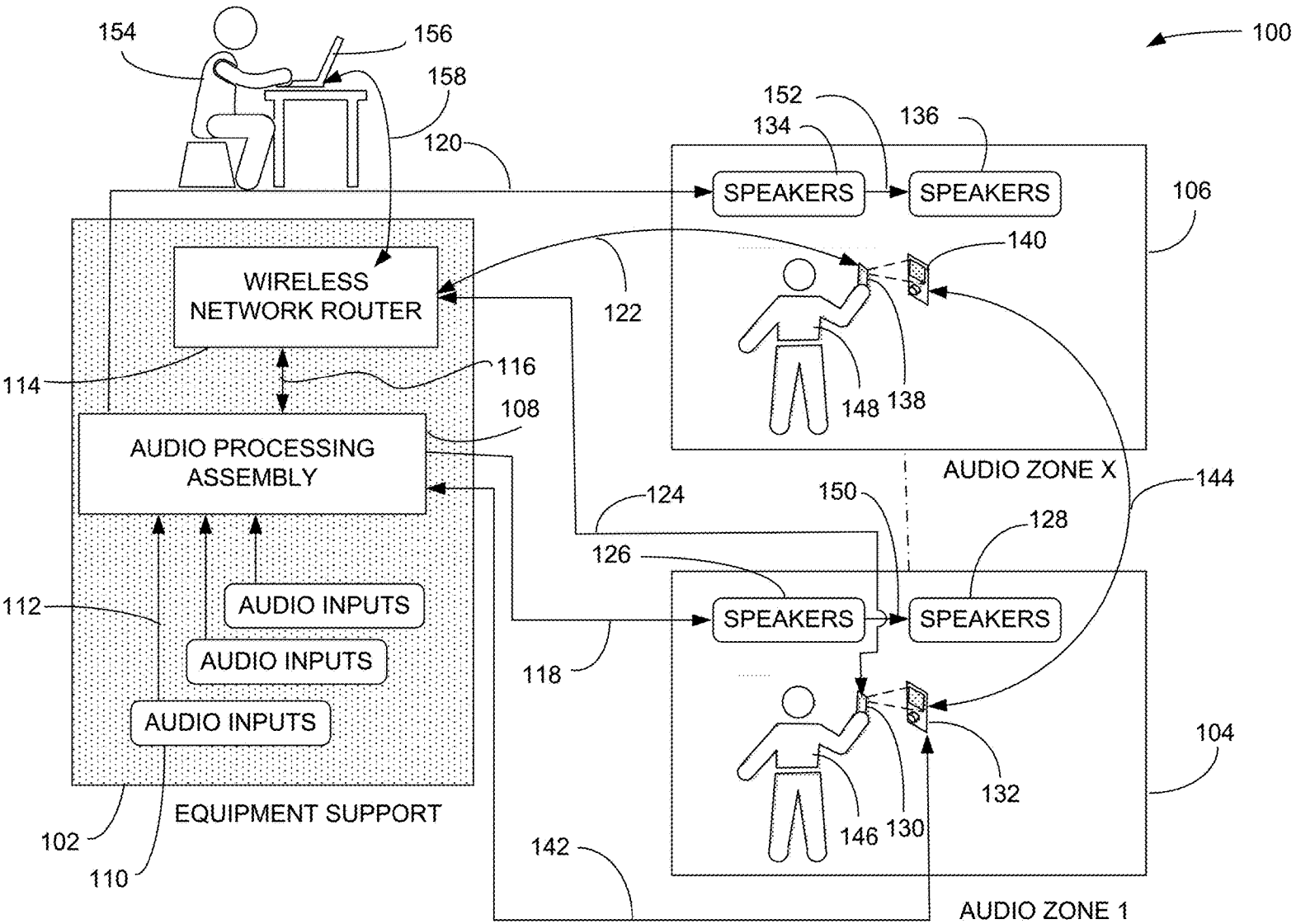
FIG. 1 is a diagrammatic view illustrating an exemplary embodiment of a QR code-based wall-mounted audio system zone controller system, according to a preferred embodiment of the present invention.

FIG. 1 is a diagrammatic view illustrating an exemplary embodiment of a QR code-based wall-mounted audio system zone controller system 100, according to a preferred embodiment of the present invention. QR code-based wall-mounted audio system zone controller system 100 includes an equipment support 102 containing an audio processing assembly 108 in communication 116 with a wireless network router 114 and receiving 112 (one of three labeled) audio inputs 110 (one of three labeled). In various embodiments, equipment support 102 may be, for non-limiting examples, an equipment closet, electronics equipment rack, electronics equipment rack cabinet, main hardware facility 502 (see FIG. 5), or shelves. Audio processing assembly 108 receives 112 audio inputs 110 from any to all of a fifth plurality of audio sources 248 (see FIG. 2) such as, without limitation, compact disc players, DVD players, radio receivers, digital memory storage, USB flash drives, audio tape players, microphones, and the like. Audio processing assembly 108 communicates 116 with a network over the wireless network router 114 and, optionally, over a hardwired connection.

QR code-based wall-mounted audio system zone controller system 100 also includes a first plurality of audio zones, illustrated as first audio zone 104 to last audio zone 106. Each audio zone 104 and 106 has a wall-mounted audio zone controller 132 and 140, respectively, of a system-wide fourth plurality of wall-mounted audio zone controllers 132 and 140. Wall-mounted audio zone controller 132 is in hardwired communication 142 with audio processing assembly 108 to receive a second plurality of control setting signals and is in daisy chained communication 144 with wall-mounted audio zone controller 140, thereby putting wall-mounted audio zone controller 140 in communication 144, 142 with audio processing assembly 108. First audio zone 104 includes a third plurality of loudspeakers 126 receiving one of a second plurality of audio signals 118 from audio processing assembly 108. Loudspeakers 126 are in daisy chained communication 150 with loudspeakers 128. Last audio zone 106 includes a plurality of loudspeakers 134 receiving one of the second plurality of audio signals 120 from audio processing assembly 108. Loudspeakers 134 are in daisy chained communication 152 with loudspeakers 136.

Wireless network router 114 is wirelessly connected, directly or indirectly, to be in communication 124 with a smart phone 130 of user 146 in the first audio zone 104. Smart phone 130 includes any device that can read a QR code 238 (see FIG. 2) and can communicate wirelessly with the same network to which wireless network router 114 is connected. Wireless network router 114 is also wirelessly connected, directly or indirectly, to be in communication 122 with a smart phone 138 of user 148 in the last audio zone 106.

The wall-mounted audio zone controller 132 can be used to display various digital images, including a QR code 238 (see FIG. 2) and provides a manual audio volume control 508 (see FIG. 5) for the first audio zone 104. The wall-mounted audio zone controller 140 has identical capabilities in last audio zone 106. Each wall-mounted audio zone controller 132 and 140, has its own unique QR code 238. As will be discussed in further detail below, user 146 can use smart phone 130 to scan unique QR code 238, which presents a unique URL 804 (see FIG. 8) unique to that wall-mounted audio zone controller 132. By selecting that URL 804, user 146 gains access to a web site that enables control of much more than just audio volume, and allows that control to be exercised by user 146 remotely from the wall-mounted audio zone controller 132. User 148 in last audio zone 106 can use smart phone 138 to scan a unique QR code distinct from QR code 238, which presents a unique URL 804 (see FIG. 8) unique to that wall-mounted audio zone controller 140. By selecting that unique URL 804, user 148 gains access to a web site that enables control of much more than just audio volume, and allows that control to be exercised by user 148 remotely from the wall-mounted audio zone controller 140. In a particular situation, user 146 may also be user 148.

As will be discussed in more detail below, settings for the wall-mounted audio zone controller 132 are made by programmer 154 using a computer 156 in communication 158 with the wireless router 114 and, thereby, the audio processing assembly 108. Computer 156 is specialized for the task by storing and running an installed custom settings software program 516 (see FIG. 5). The computer thereby changes the capabilities of the wall-mounted audio zone controller 132. In a particular embodiment, computer 156 has a hardwired connection to audio processing assembly 108.

Figure 2:
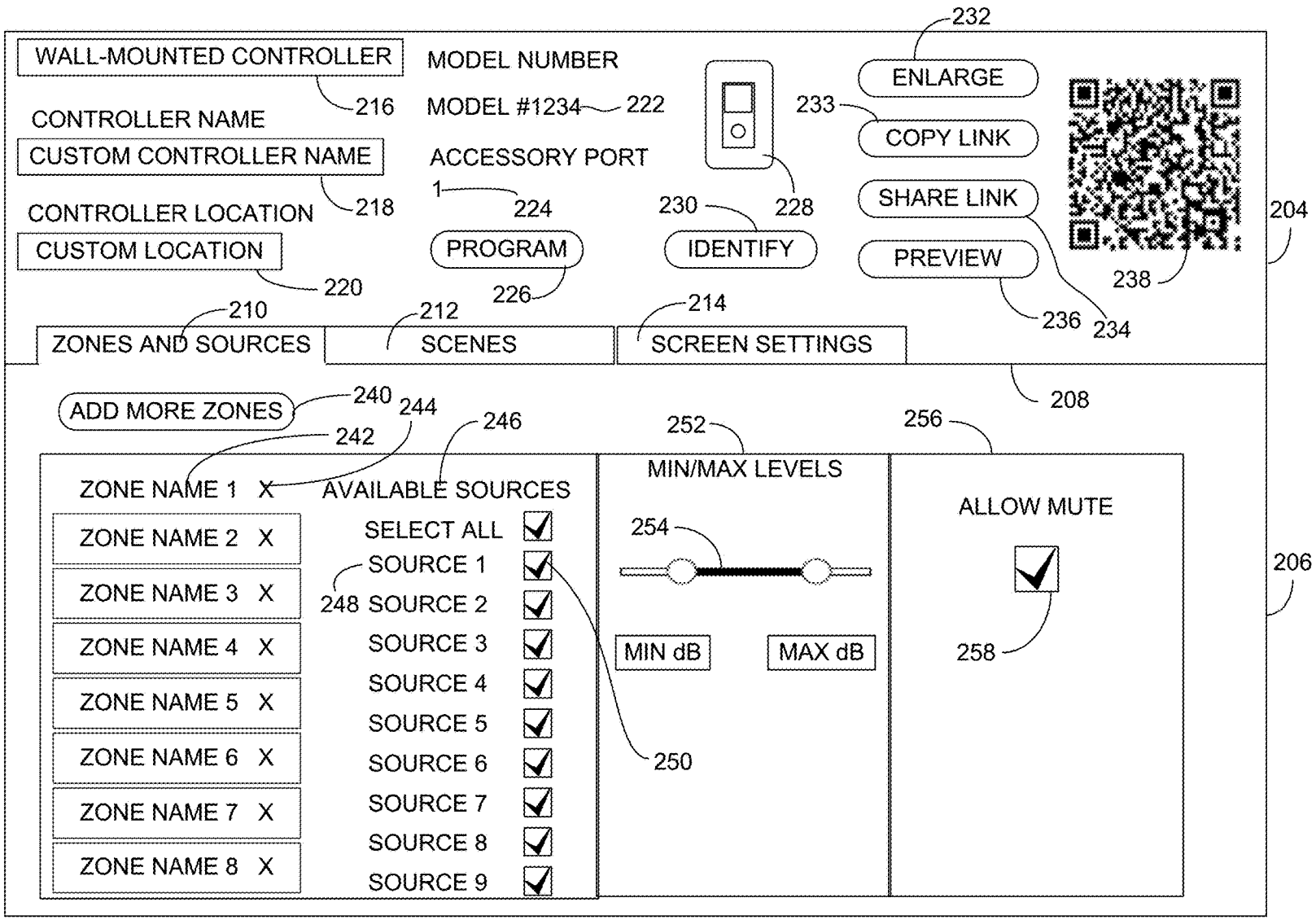
FIG. 2 is a diagrammatic view illustrating an exemplary embodiment of a first interactive display used for programming the QR code-based wall-mounted audio system zone controller system of FIG. 1, according to a preferred embodiment of the present invention.

FIG. 2 is a diagrammatic view illustrating an exemplary embodiment of a first interactive display 202 used for programming the QR code-based wall-mounted audio system zone controller system 100 of FIG. 1, according to a preferred embodiment of the present invention. To set up a wall-mounted audio zone controller 132, programming with a personal computer 156 or device with similar relevant functionality, is required. The computer 156 must have an installed custom settings software program 516 which provides three interactive displays 202, 302, and 402 for programming settings for the wall-mounted audio zone controller 132, and all of the other the wall-mounted audio zone controllers 140, etc. First interactive display 202 has a header 204 and a selection panel 206 for selecting programming options for the wall-mounted audio zone controller 132. Header 204 contains information identifying the particular wall-mounted audio zone controller 132. This header information is input to the header 204 the first time the wall-mounted audio zone controller 132 is programmed. Header 204 includes a title bar 216, a custom (unique) controller name 218, and a custom (unique) location 220 of the wall-mounted audio zone controller 132. Header 204 also includes a model number 222 of the wall-mounted audio zone controller 132 and an identification of the accessory port 224 of the audio processing assembly 108 to which the wall-mounted audio zone controller 132 is connected. Once the previously discussed identification information has been entered, a real-world image 228 of the wall-mounted audio zone controller 132 is displayed and the unique QR code 238 is created for that wall-mounted audio zone controller 132. Header 204 also includes a PROGRAM activator 226 used to send programmed settings over the network to the wall-mounted audio zone controller 132. The activator 230 labeled IDENTIFY is used to activate an indication on the wall-mounted audio zone controller 132 to make it easier to find for user 146. For non-limiting examples, touching the IDENTIFY activator 230 may cause the digital display screen 506 (see FIG. 5) on the wall-mounted audio zone controller 132 to temporarily flash, change to a bright color, or present a highly dynamic design.

QR code 238 is presented with options to enlarge 232 the image, copy the link 233 associated with the QR code 238, share the link 234 associated with the QR code 238, and preview 236 the URL associated with the QR code 238.

Selection panel 206 includes a settings menu 208 with three tabs: zones and sources 210, scenes 212, and screen settings 214. FIG. 2 shows sources tab 210 as open. In tab 210, selection is made from a first plurality of audio zones 242 (one of eight labeled) which may be controlled by the wall-mounted audio zone controller 132 that is identified in the header 204. Audio zone 242 is indicated 244 as selected for the wall-mounted audio zone controller 132 and is selected (open frame) for selection from a list of a fifth plurality of available audio sources 248 (one of nine labeled). The programmer 156 may add zones 240 to the list. The available audio sources 246 column enables selection 250 of which audio sources 248 are available to be accessed in each audio zone 242 that has been selected for a particular wall-mounted audio zone controller 132. As illustrated, all nine sources 248 are available to audio zone 242, which may be audio zone 104, 106, or an additional audio zone as shown. Sub window 252 enables the programmer 154 to place upper and lower limits on the audio volume range 254 controllable by wall-mounted audio zone controller 132 and smart phone 130. Sub window 256 enables the programmer 154 to allow 258 the wall-mounted audio zone controller 132 and smart phone 130 to mute the audio for audio zones 242 associated with wall-mounted audio zone controller 132. In a particular situation, programmer 154 may also be user 146 and/or user 148.

Figure 3:
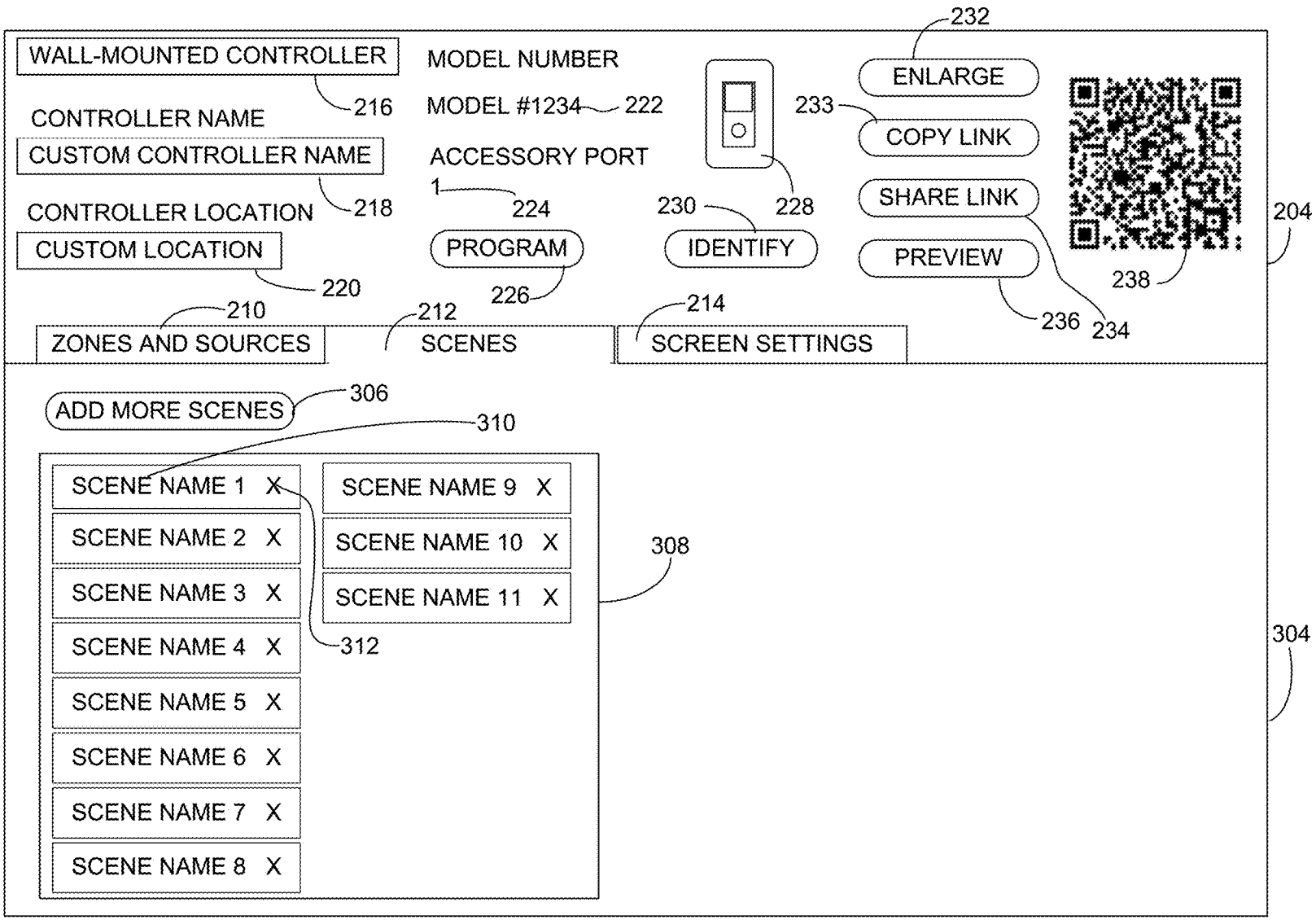
FIG. 3 is a diagrammatic view illustrating an exemplary embodiment of a second interactive display used for programming the QR code-based wall-mounted audio system zone controller system of FIG. 1, according to a preferred embodiment of the present invention.

FIG. 3 is a diagrammatic view illustrating an exemplary embodiment of a second interactive display 302 used for programming the QR code-based wall-mounted audio system zone controller system 100 of FIG. 1, according to a preferred embodiment of the present invention. Header 204 is the same as header 204 in FIG. 2. Selection panel 304 has the scenes selection menu tab 212 open. Sub window 308 enables the programmer 154 to select specific scenes 310 (one of eleven labeled) from a list of a sixth plurality of scenes 310 to which the wall-mounted audio zone controller 132 has access. A "scene", as used and defined herein, is a predetermined set of common user-controlled parameters used for making system-wide changes with a single input. Scenes 310 may include, for non-limiting examples, audio zone source select, audio zone volume, and audio zone mute status. A scene 310 can be recalled from any numbers of smart phones 130, tablets, or computers that are each served off the main hardware facility 502 (see FIG. 5). A scene 310 can be recalled on an event that is set up in a scheduler. For non-limiting examples, scenes may be created for "store open", "store closed", "karaoke time", and "trivia night".

Figure 4:
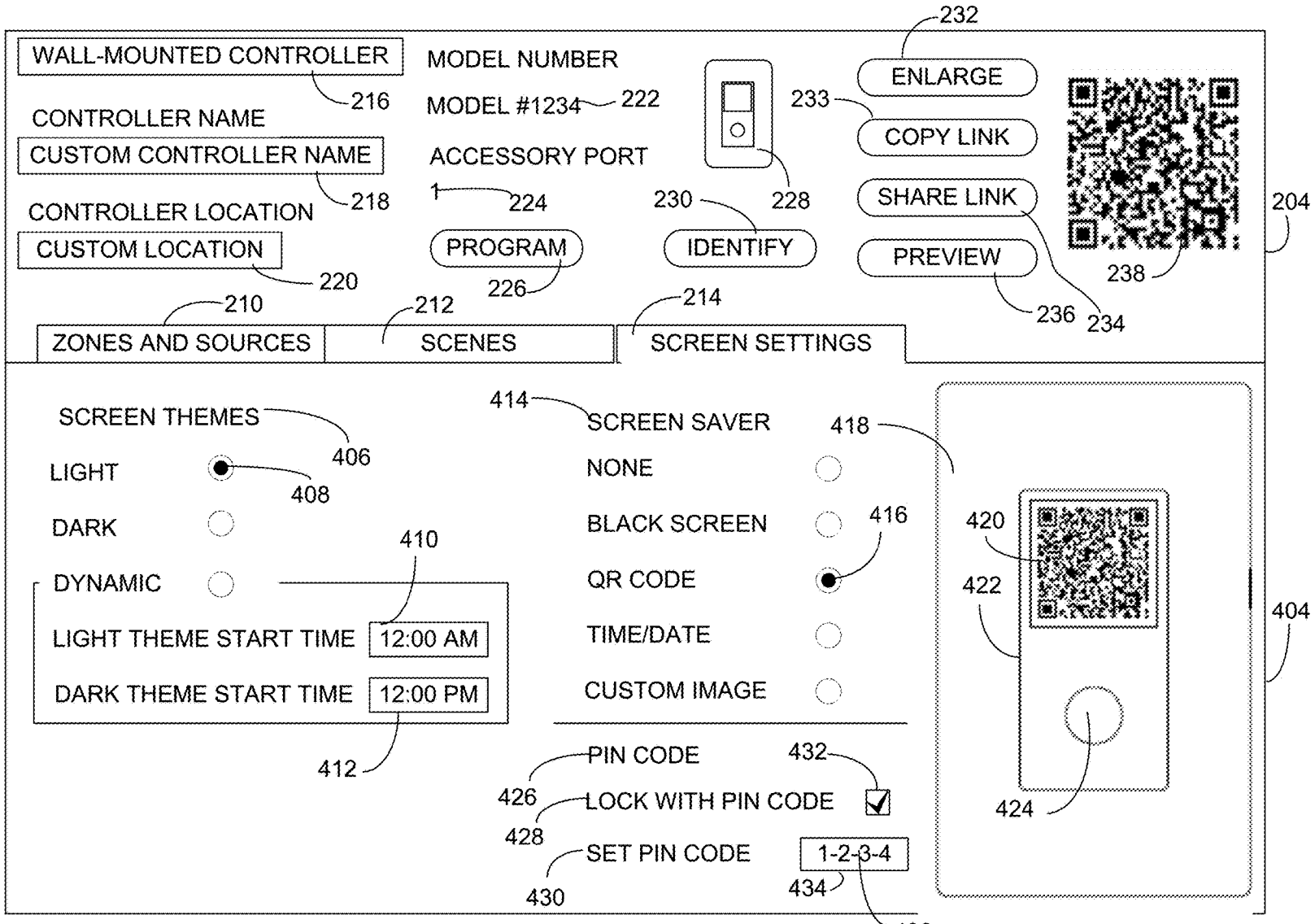
FIG. 4 is a diagrammatic view illustrating an exemplary embodiment of a third interactive display used for programming the QR code-based wall-mounted audio system zone controller system of FIG. 1, according to a preferred embodiment of the present invention.

FIG. 4 is a diagrammatic view illustrating an exemplary embodiment of a third interactive display 402 used for programming the QR code-based wall-mounted audio system zone controller system 100 of FIG. 1, according to a preferred embodiment of the present invention. Header 204 is the same as header 204 in FIG. 2. Selection panel 404 has the screen settings selection menu tab 214 open. Screen themes 406 enable the programmer 154 to select, via radio buttons 408 (one of three labeled), light, dark, or dynamic themes for the digital display screen 506 (see FIG. 5) of the wall-mounted audio zone controller 132. If a dynamic theme is chosen, start times 410, 412 may be entered for light and dark themes, respectively.

Screen saver 414 options are selected by radio buttons 416 (one of five labeled) of a seventh plurality of screen saver 414 options and generate a preview 418 of how the real-world wall-mounted audio zone controller 132 will look. The QR code radio button 416 is illustrated as selected, resulting in a preview 418 of the wall-mounted audio zone controller 132 with a QR code 238 reduced image 420 on a wall-mounted audio zone controller image 422 showing an image 424 of the audio volume control knob 508 (see FIG. 5). If the "QR code" option is not selected, initialization of the remote-control functions for that wall-mounted audio zone controller 132 is not possible. The screen settings tab 214 also provides a heading 426 to create a PIN code lock 428. If a PIN code lock 428 is selected 432, the PIN code lock 428 is set 430 by entering the PIN code 436 in window 434.

Figure 5:
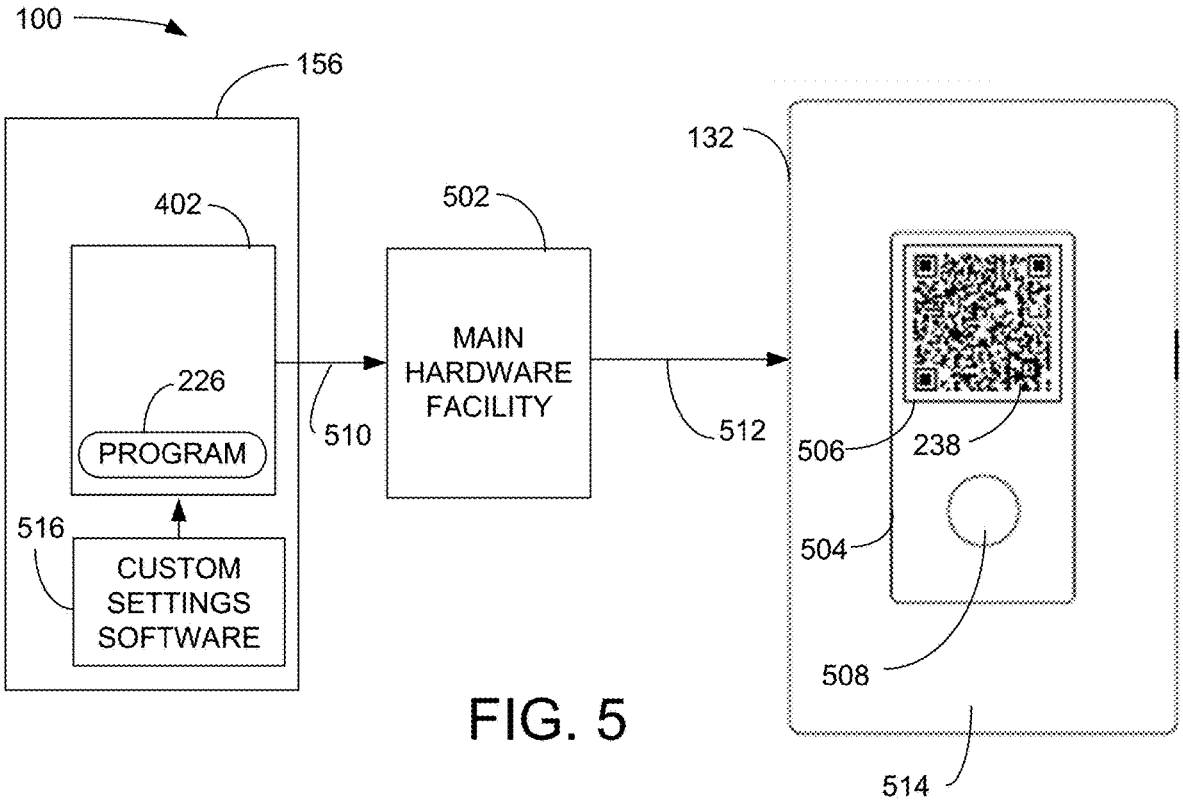
FIG. 5 is a diagrammatic view illustrating an exemplary embodiment of transfer of programmed settings to the QR code-based wall-mounted audio system zone controller system of FIG. 1, according to a preferred embodiment of the present invention.

FIG. 5 is a diagrammatic view illustrating an exemplary embodiment of transfer 510, 512 of programmed settings within the QR code-based wall-mounted audio system zone controller system 100 of FIG. 1, according to a preferred embodiment of the present invention. When the PROGRAM activator 226 on third interactive display 402 the settings are transferred 510 to the main hardware facility 502 and then transferred 512 to the wall-mounted audio zone controller 132 where the transferred settings control the digital display screen 506. Wall plate 514 is preferably a standard-sized wall plate 514, such as a switch plate or electric outlet plate. The screw holes are not shown. Controller body 504 supports digital display screen 506 and audio volume control knob 508.

Main hardware facility 502 includes the equipment support 102 and all of its contents, a power supply, a custom display, a custom output connector board, and a custom main board.

Figure 6:
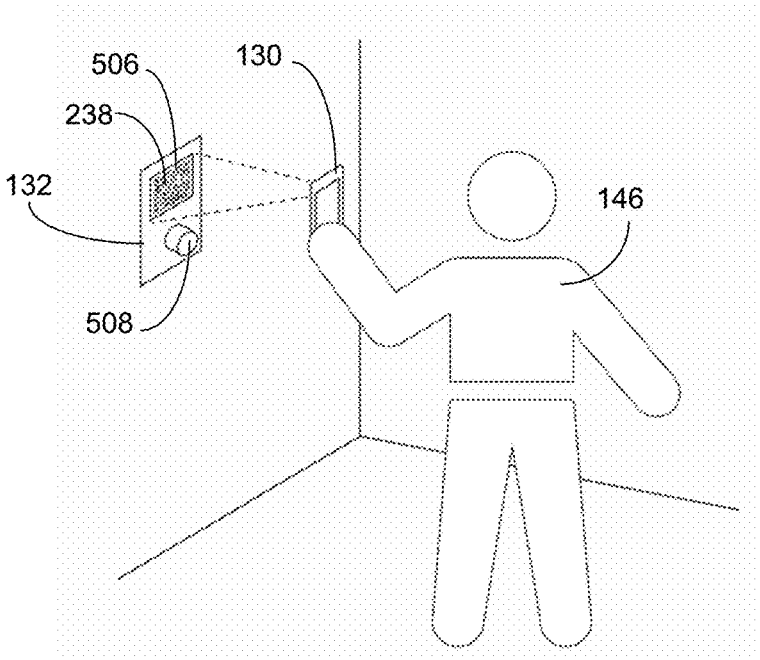
FIG. 6 is a diagrammatic view illustrating an exemplary embodiment of a first step for using the QR code-based wall-mounted audio system zone controller system of FIG. 1, according to a preferred embodiment of the present invention.

FIG. 6 is a diagrammatic view illustrating an exemplary embodiment of a first step for using the QR code-based wall-mounted audio system zone controller system 100 of FIG. 1, according to a preferred embodiment of the present invention. User 146 is shown scanning QR code 238 from the digital display screen 506 of wall-mounted audio zone controller 132 using a smart phone 130.

Figure 7:
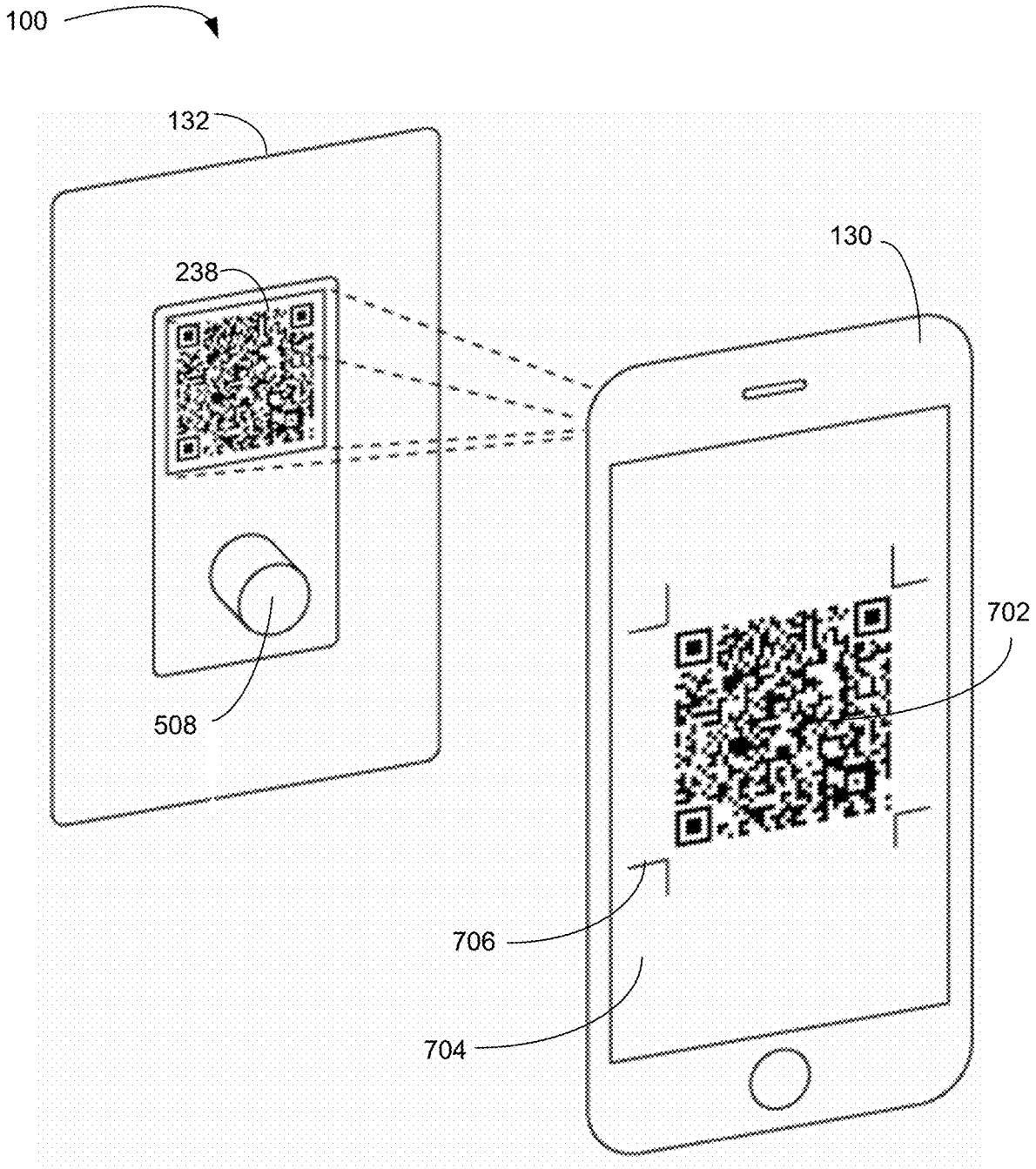
FIG. 7 is a diagrammatic view illustrating an exemplary embodiment of a detail of the first step for using the QR code-based wall-mounted audio system zone controller system of FIG. 1, according to a preferred embodiment of the present invention.

FIG. 7 is a diagrammatic view illustrating an exemplary embodiment of a detail of the first step for using the QR code-based wall-mounted audio system zone controller system 100 of FIG. 1, according to a preferred embodiment of the present invention. The user 146 has aligned the QR code image 702 within the image delineators 706 on the screen 704 of smart phone 130 in preparation for scanning the QR code 238. A native application in the smart phone 130 is preferably used for aligning and scanning.

Figure 8:
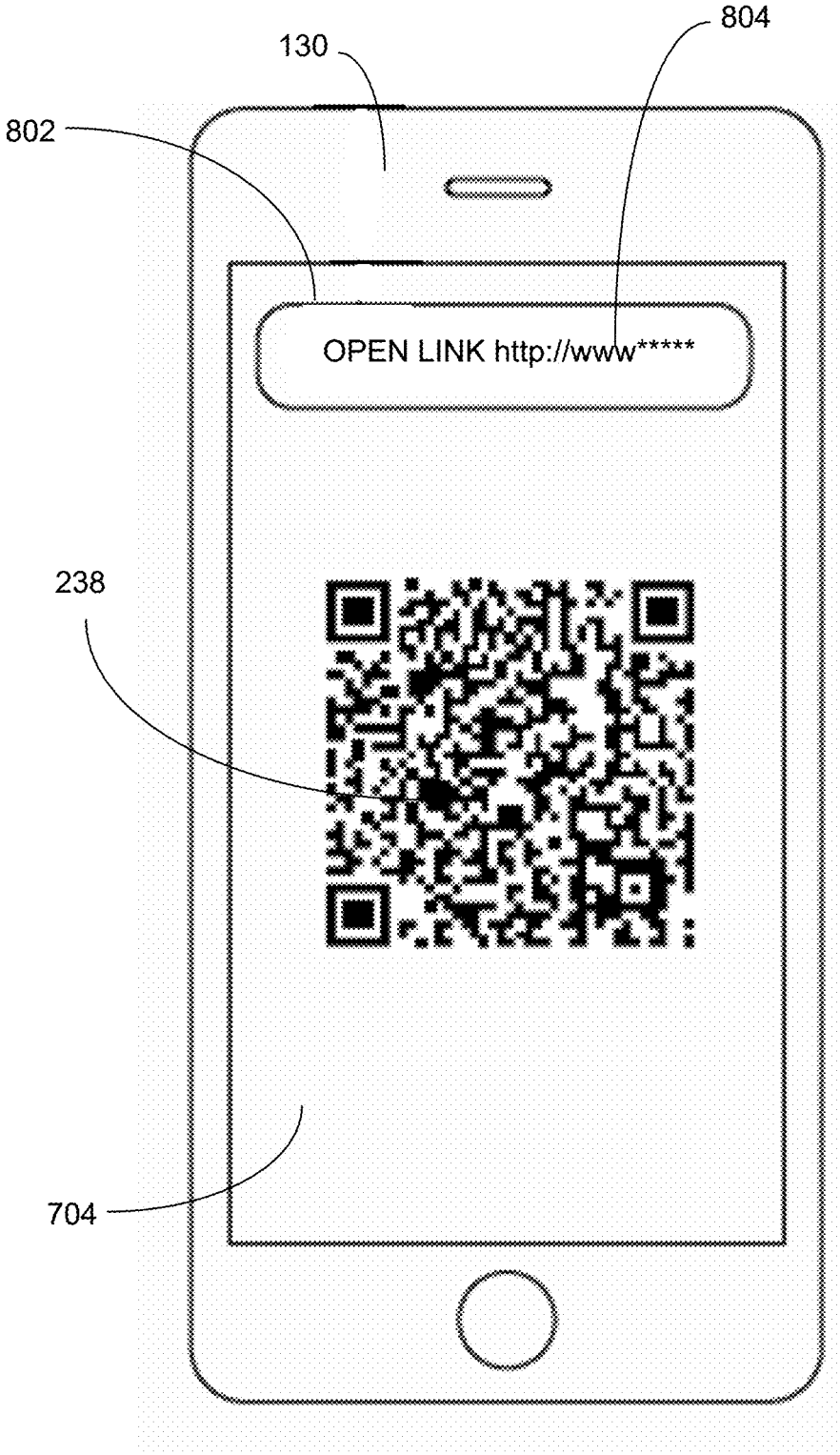
FIG. 8 is a diagrammatic view illustrating an exemplary embodiment of a second step for using the QR code-based wall-mounted audio system zone controller system of FIG. 1, according to a preferred embodiment of the present invention.

FIG. 8 is a diagrammatic view illustrating an exemplary embodiment of a second step for using the QR code-based wall-mounted audio system zone controller system 100 of FIG. 1, according to a preferred embodiment of the present invention. Once the QR code 238 is scanned into smart phone 130, the native application translates the QR code 238 into a URL 804, which is presented to user 146 in selection window 802.

Figure 9:
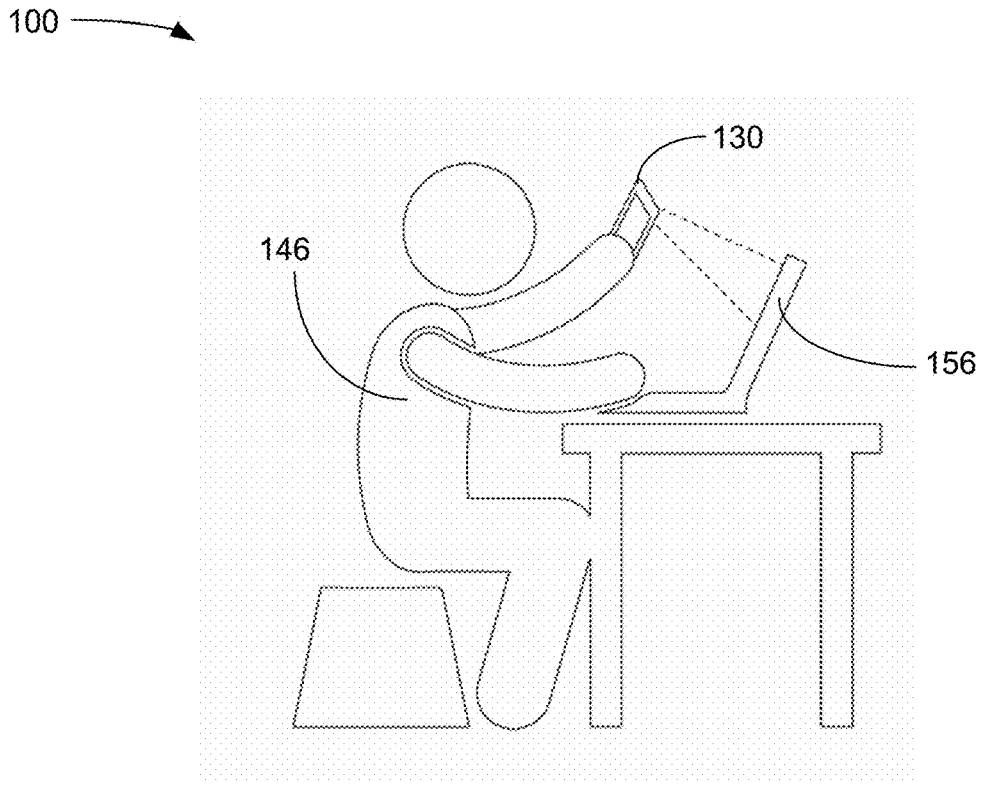
FIG. 9 is a diagrammatic view illustrating an exemplary embodiment of a second approach to the first step for using the QR code-based wall-mounted audio system zone controller system of FIG. 1, according to a preferred embodiment of the present invention.

FIG. 9 is a diagrammatic view illustrating an exemplary embodiment of a second approach to the first step for using the QR code-based wall-mounted audio system zone controller system 100 of FIG. 1, according to a preferred embodiment of the present invention. User 146 may scan the QR code 238 directly off any one of the interactive displays 202, 302, or 402 on computer 156 using smart phone 130.

Figure 10:
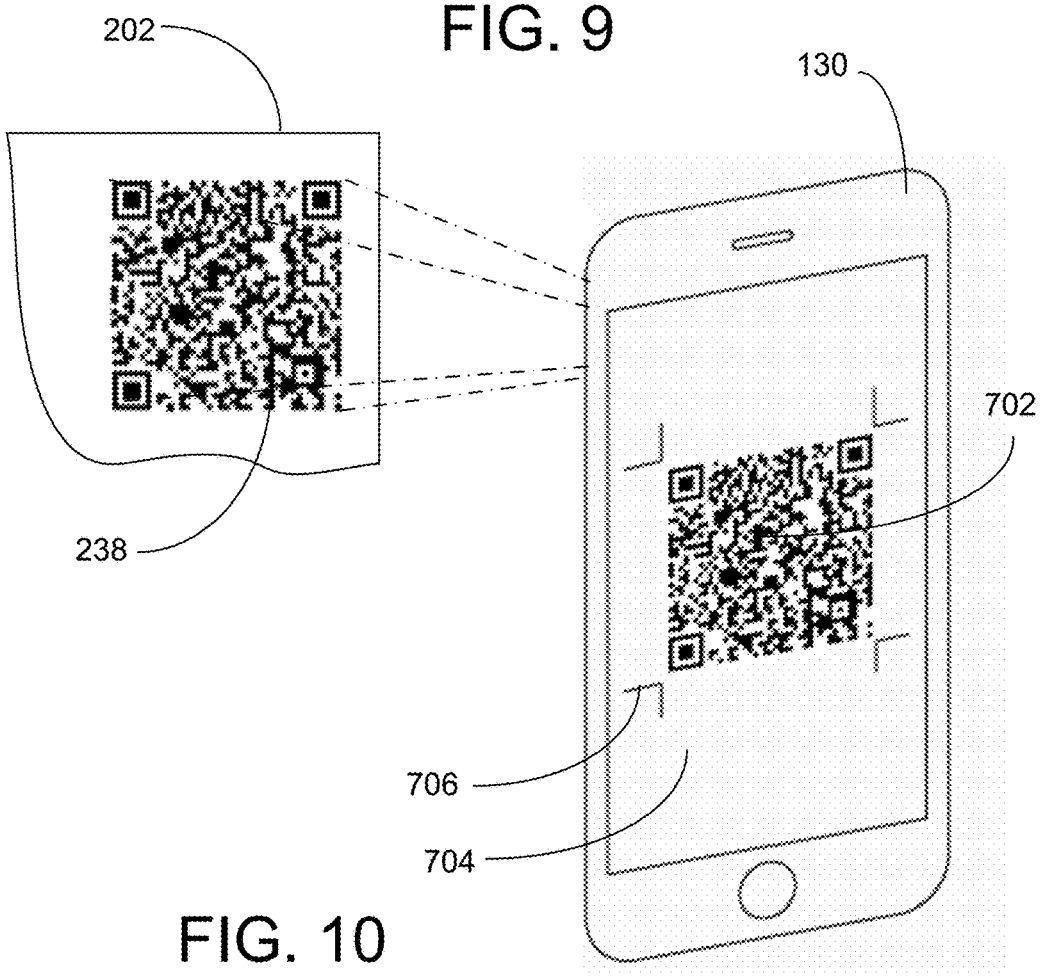
FIG. 10 is a diagrammatic view illustrating an exemplary embodiment of a detail of the second approach to the first step for using the QR code-based wall-mounted audio system zone controller system of FIG. 1, according to a preferred embodiment of the present invention.

FIG. 10 is a diagrammatic view illustrating an exemplary embodiment of a detail of the second approach to the first step for using the QR code-based wall-mounted audio system zone controller system 100 of FIG. 1, according to a preferred embodiment of the present invention. The user 146 has aligned the QR code 238 within the image delineators 706 on the screen 704 of smart phone 130 in preparation for scanning the QR code 238 directly off any one of the interactive displays 202, 302, or 402. Once scanned, the second approach proceeds as with FIG. 8.

Figure 11:
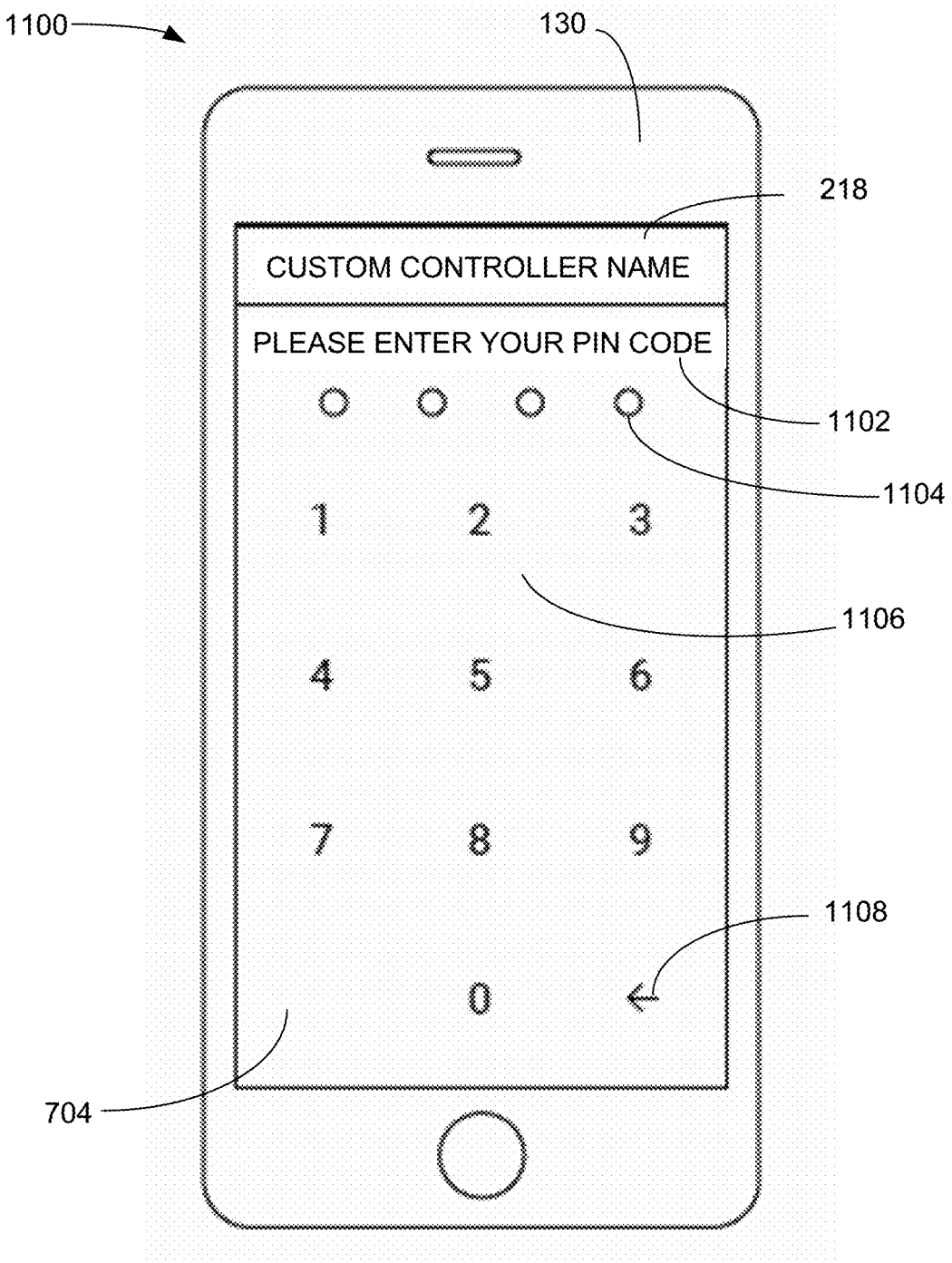
FIG. 11 is a diagrammatic view illustrating an exemplary embodiment of a first screen of the website-based controller on a smart phone of the QR code-based wall-mounted audio system zone controller system of FIG. 1, according to a preferred embodiment of the present invention.

FIG. 11 is a diagrammatic view illustrating an exemplary embodiment of a first screen of the website-based controller 1100 on a smart phone 130 using the QR code-based wall-mounted audio system zone controller system 100 of FIG. 1, according to a preferred embodiment of the present invention. The illustrated screen only appears if a PIN code lock 428 is selected 432 in the screen settings tab 214, as shown in FIG. 4. Website-based controller 1100 provides the custom controller name 218 from first interactive display 202 and an instruction 1102 to enter the PIN code 436. A numeric pad 1106 is provided along with indicators 1104 (one of four labeled) of each numeric entry. When entry of the PIN code 436 is complete, the return icon 1108 is touched to submit the PIN code 436 to the QR code-based wall-mounted audio system zone controller system 100.

Figure 12:
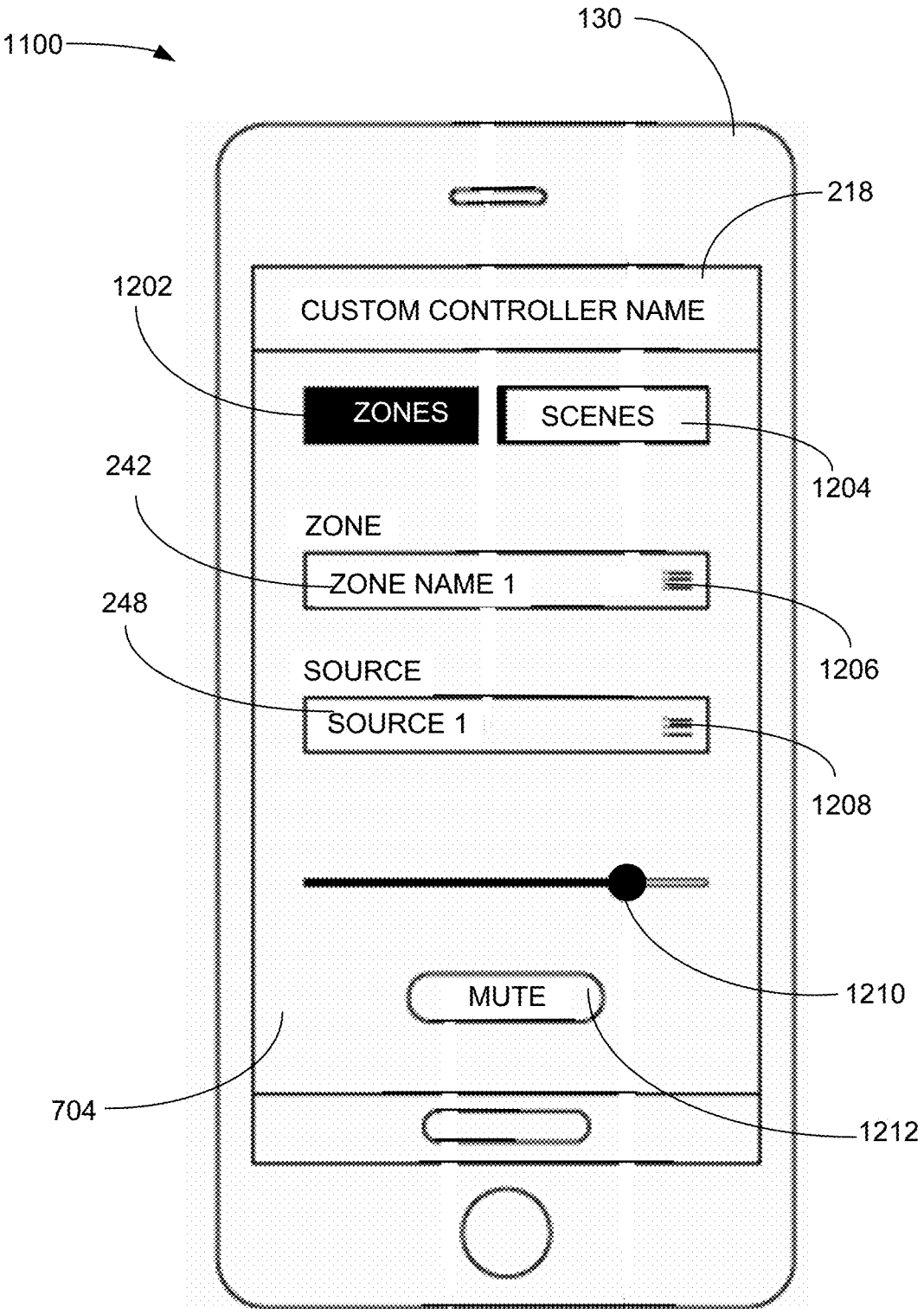
FIG. 12 is a diagrammatic view illustrating an exemplary embodiment of a second screen of the website-based controller on a smart phone of the QR code-based wall-mounted audio system zone controller system of FIG. 1, according to a preferred embodiment of the present invention.

FIG. 12 is a diagrammatic view illustrating an exemplary embodiment of a second screen of the website-based controller 1100 on a smart phone 130 using the QR code-based wall-mounted audio system zone controller system 100 of FIG. 1, according to a preferred embodiment of the present invention. The website-based controller 1100 presents options for selecting zones 1202 or scenes 1204. "ZONES" 1202 is shown as selected. The user 146 may select any of the audio zones 242 programmed for the associated wall-mounted audio zone controller 132 using the menu icon 1206. The user 146 may select any of the audio sources 248 programmed for the selected audio zone 242 for the associated wall-mounted audio zone controller 132 using the menu icon 1208. The user 146 may adjust the audio zone's audio volume by swiping the volume icon 1210. The user 146 may touch activate the mute button 1212 to mute the selected audio zone 242 if the "allow mute" checkbox 258 was selected on the first interactive display 202.

Figure 13:
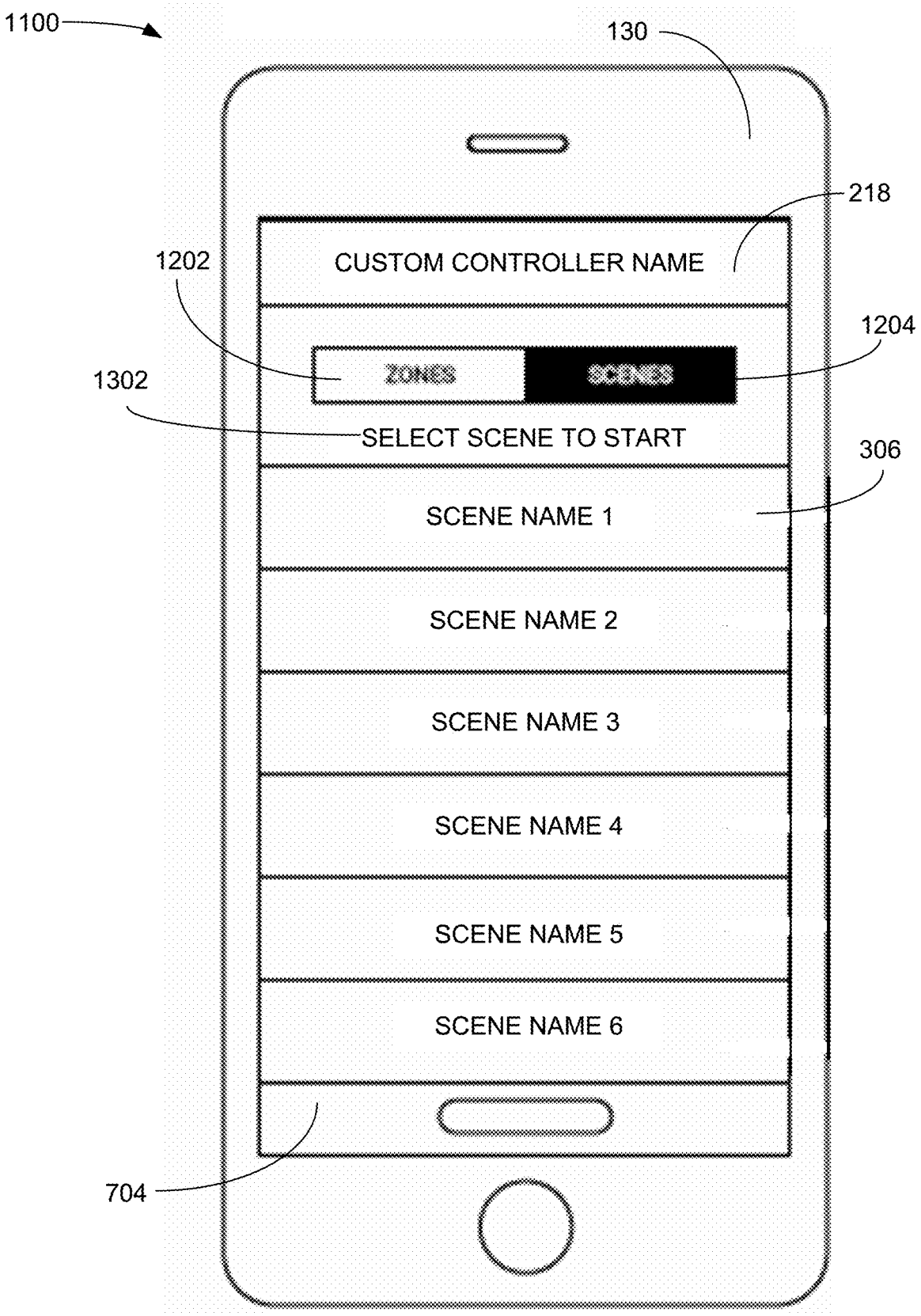
FIG. 13 is a diagrammatic view illustrating an exemplary embodiment of a third screen of the website-based controller on a smart phone of the QR code-based wall-mounted audio system zone controller system of FIG. 1, according to a preferred embodiment of the present invention.

FIG. 13 is a diagrammatic view illustrating an exemplary embodiment of the second screen of the website-based controller 1100 on a smart phone 130 of the QR code-based wall-mounted audio system zone controller system 100 of FIG. 1, according to a preferred embodiment of the present invention. The "SCENES" tab 1204 is shown selected, and an instruction 1302 to select a scene is provided. By selecting a scene 306, the user 146 installs the predetermined settings of that scene 306.

The claims below contain functional language and do not include any statements of intended use.

We claim:

1. A QR code-based wall-mounted audio system zone controller system comprising:

a. an audio processing assembly;

b. a network comprising a wireless network router in communication with said audio processing assembly;

c. a first plurality of audio zones configured to receive a respective plurality of audio signals and a second plurality of control settings signals from said audio processing assembly, each said audio zone of said first plurality of audio zones comprising:

d. a third plurality of loudspeakers operable to receive said respective plurality of audio signals from said audio processing assembly;

e. a fourth plurality of wall-mounted audio zone controllers in communication with said audio processing assembly to receive said respective second plurality of control settings signals;

f. a digital display screen mounted on each said wall-mounted audio zone controller of said fourth plurality of wall-mounted audio zone controllers; and g. wherein each particular said digital display screen is operable to display a scannable image of a OR code unique to said particular wall-mounted audio zone controller and translatable into a unique URL addressing a unique website on said wireless network, wherein a user may provide inputs via said website to remotely change audio settings for said respectively particular wall-mounted audio zone controller.

2. The system of claim 1, wherein said unique QR code is created responsive to information uniquely identifying said particular wall-mounted audio zone controller.

3. The system of claim 2, comprising a smartphone connectable to said wireless network and operable, when connected, to scan said unique QR code from said particular digital display screen of said particular wall-mounted audio zone controller, translate said QR code into a unique URL, open said website using said URL, and enable a user to use pages of said unique website to remotely change audio settings particular to said particular wall-mounted audio zone controller.

4. The system of claim 2, comprising a custom audio settings computer software program resident in a computer connected to said network and operable to enable user input of said information uniquely identifying said particular wall-mounted audio zone controller.

5. The system of claim 2, comprising said custom audio settings computer software program resident in a computer connected to said network and operable to enable user input of audio system settings optionally unique to each said particular wall-mounted audio zone controller.

6. A QR code-based wall-mounted audio system zone controller system comprising:

a. an audio processing assembly;

b. a network comprising a wireless network router in communication with said audio processing assembly;

c. a first plurality of audio zones configured to receive a respective plurality of audio signals and a second plurality of control settings signals from said from said audio processing assembly, each said audio zone of said first plurality of audio zones comprising:

i. a third plurality of loudspeakers operable to receive said audio signals from said audio processing assembly; and ii. a fourth plurality of wall-mounted audio zone controllers in communication with said audio processing assembly;

d. a digital display screen mounted on each particular said wall-mounted audio zone controller of said fourth plurality of wall-mounted audio zone controllers; and e. wherein each particular said digital display screen is operable to display a scannable image of a QR code that is unique to said particular wall-mounted audio zone controller.

7. The system of claim 6, comprising a daisy chain communication route from said audio processing assembly through said fourth plurality of wall-mounted audio zone controllers.

8. The system of claim 6, comprising a fifth plurality of audio sources in communication with said audio processing assembly.

9. The system of claim 8, comprising:

a. a fourth plurality of websites on said wireless network having corresponding URLs, each said URL unique to one said wall-mounted audio zone controller of said fourth plurality of wall-mounted audio zone controllers, wherein each said URL is representable by one said unique QR code; and b. each said website is user-accessible to provide a plurality of pages enabling said user to remotely set wall-mounted audio zone controller parameters.

10. The system of claim 9, comprising a computer storing, and operable to run, a custom audio settings software program, said custom audio settings software program:

a. enabling a user to input unique identifying data for each said wall-mounted audio zone controller of said fourth plurality of wall-mounted audio zone controllers; and b. operable to generate and display a unique QR code for a particular said wall-mounted audio zone controller of said fourth plurality of wall-mounted audio zone controllers, responsive to said user input of identifying data for said particular wall-mounted audio zone controller of said fourth plurality of wall-mounted audio zone controllers.

11. The system of claim 10, wherein said custom audio settings software program is further operable to enable:

a. user selection of one or more audio zones controllable by a particular said wall-mounted audio zone controller of said fourth plurality of wall-mounted audio zone controllers;

b. user selection of one or more said audio sources of said plurality of audio sources available to each audio zone of said one or more audio zones controllable by a particular said wall-mounted audio zone controller of said fourth plurality of wall-mounted audio zone controllers;

c. user adjustment of minimum and maximum audio volume levels for each audio zone of said one or more audio zones controllable by a particular said wall-mounted audio zone controller of said fourth plurality of wall-mounted audio zone controllers; and d. user input to give a mute capability to a particular said wall-mounted audio zone controller of said fourth plurality of wall-mounted audio zone controllers.

12. The system of claim 10, wherein said custom audio settings software program is further operable to enable:

a. user selection of one or more scenes from a list of a sixth plurality of scenes, wherein:

i. each scene on said list of a sixth plurality of scenes comprises a predetermined set of audio system parameters; and ii. said user selection makes said selected scene available to a particular said wall-mounted audio zone controller of said fourth plurality of wall-mounted audio zone controllers; and b. a user to add a new scene to said list.

13. The system of claim 10, wherein said custom audio settings software program is further operable to enable a user to:

a. select a screen theme for adjusting and scheduling the brightness of a particular said digital display screen mounted on a particular said wall-mounted audio zone controller of said plurality of wall-mounted audio zone controllers;

b. select a screen saver image, from a list of a seventh plurality of screen saver images, for said particular said digital display screen mounted on said particular wall-mounted audio zone controller of said fourth plurality of wall-mounted audio zone controllers; wherein one selectable screen saver image comprises said unique QR code;

c. view an image of the front of said particular wall-mounted audio zone controller of said fourth plurality of wall-mounted audio zone controllers, responsive to said selection of said screen saver image; and d. set a PIN code for a particular said wall-mounted audio zone controller of said fourth plurality of wall-mounted audio zone controllers.

14. The system of claim 10, comprising a smart phone:

a. wirelessly connectable to said wireless network;

b. operable to scan said unique QR code from said digital display screen;

c. operable to translate said scanned unique QR code into said unique URL;

d. operable to access said unique website addressed by said unique URL;

e. operable to display pages of said unique website;

f. operable to enable a user to change audio settings remotely.

15. A QR code-based wall-mounted audio system zone controller system comprising:

a. an audio processing assembly;

b. a network comprising a wireless network router in communication with said audio processing assembly;

c. a first plurality of audio zones configured to receive a respective plurality of audio signals and a second plurality of controller settings signals from said audio processing assembly, each said audio zone of said first plurality of audio zones comprising:

i. a third plurality of loudspeakers operable to receive said audio signal from said audio processing assembly;

ii. a fourth plurality of wall-mounted audio zone controllers in communication with said audio processing assembly to receive said respective second plurality of control settings signals;

d. a digital display screen mounted on each particular said wall-mounted audio zone controller of said third plurality of wall-mounted audio zone controllers;

e. wherein each particular said digital display screen is operable to display a scannable image of a QR code unique to said particular wall-mounted audio zone controller and translatable into a unique URL addressing a unique website on said wireless network, wherein a user may provide inputs via said website to remotely change audio settings for said respectively particular wall-mounted audio zone controller;

f. a custom audio settings computer software program resident in a computer connected to said network and operable to enable user input of said information uniquely identifying said particular wall-mounted audio zone controller;

g. said custom audio settings computer software program resident in said computer connected to said network and operable to enable user input of audio system settings optionally unique to each said particular wall-mounted audio zone controller and h. wherein said unique QR code is created responsive to said information uniquely identifying said particular wall-mounted audio zone controller.

16. The system of claim 15, comprising a smartphone connectable to said wireless network router and operable, when connected, to scan said unique QR code from said particular digital display screen of said particular wall-mounted audio zone controller, translate said QR code into a unique URL, open said website using said URL, and enable said user to use pages of said unique website to remotely change audio settings particular to said particular wall-mounted audio zone controller.

17. The system of claim 15, comprising said computer storing, and operable to run, a custom audio settings software program, said custom audio settings software program:

a. enabling a user to input identifying data for each said wall-mounted audio zone controller of said fourth plurality of wall-mounted audio zone controllers; and b. operable to generate and display a unique QR code for a particular said wall-mounted audio zone controller of said fourth plurality of wall-mounted audio zone controllers, responsive to said user input of identifying data for said particular wall-mounted audio zone controller of said fourth plurality of wall-mounted audio zone controllers.

18. The system of claim 15, wherein said custom audio settings software program is further operable to enable:

a. user selection of one or more audio zones controllable by a particular said wall-mounted audio zone controller of said fourth plurality of wall-mounted audio zone controllers;

b. user selection of one or more said audio sources of a fifth plurality of said audio sources connected as inputs to said audio processing assembly and user selectable to be available to each wall-mounted audio zone controller of said fourth plurality of wall-mounted audio zone controllers;

c. user adjustment of minimum and maximum audio volume levels for each said wall-mounted audio zone controller of said fourth plurality of wall-mounted audio zone controllers; and d. user input to give a mute capability to a particular said wall-mounted audio zone controller of said fourth plurality of wall-mounted audio zone controllers.

19. The system of claim 15, wherein said custom audio settings software program is further operable to enable:

a. user selection of one or more scenes from a list of a sixth plurality of scenes, wherein:

i. each scene on said list of said sixth plurality of scenes comprises a predetermined set of audio system parameters; and ii. said user selection makes said selected scene available to a particular said wall-mounted audio zone controller of said fourth plurality of wall-mounted audio zone controllers; and b. a user to add a new scene to said list.

20. The system of claim 15, wherein said custom audio settings software program is further operable to enable a user to:

a. select a screen theme for adjusting and scheduling the brightness of a particular said digital display screen mounted on a particular said wall-mounted audio zone controller of said fourth plurality of wall-mounted audio zone controllers;

b. select a screen saver image, from a list of a seventh plurality of screen saver images, for said particular said digital display screen mounted on said particular wall-mounted audio zone controller of said fourth plurality of wall-mounted audio zone controllers; wherein one selectable screen saver image comprises said unique QR code;

c. view an image of the front of said particular wall-mounted audio zone controller of said fourth plurality of wall-mounted audio zone controllers, responsive to said selection of said screen saver image; and d. set a PIN code for a particular said wall-mounted audio zone controller of said fourth plurality of wall-mounted audio zone controllers.

* * * * *